US010995519B2

(12) United States Patent
Mann

(10) Patent No.: US 10,995,519 B2
(45) Date of Patent: May 4, 2021

(54) FENCE PLINTH MEMBER

(71) Applicant: Gram Engineering Pty Ltd, New South Wales (AU)

(72) Inventor: Ronald Leslie Mann, New South Wales (AU)

(73) Assignee: GRAM ENGINEERING PTY LTD, New South Wales (AU)

( * ) Notice: Subject to any disclaimer, the term of this patent is extended or adjusted under 35 U.S.C. 154(b) by 508 days.

(21) Appl. No.: 16/009,840

(22) Filed: Jun. 15, 2018

(65) Prior Publication Data

US 2019/0010726 A1 Jan. 10, 2019

(30) Foreign Application Priority Data

Jun. 16, 2017 (AU) ..... 2017902312

(51) Int. Cl.
*E04H 17/16* (2006.01)
*E04H 17/06* (2006.01)

(52) U.S. Cl.
CPC ..... *E04H 17/16* (2013.01); *E04H 17/063* (2013.01)

(58) Field of Classification Search
CPC ..... E04H 17/08; E04H 17/14; E04H 17/16; E04H 17/165; E04H 17/166; E04H 17/20;
(Continued)

(56) References Cited

U.S. PATENT DOCUMENTS 3,820,295 A * 6/1974 Folley ..... E04B 1/08 52/270
5,056,348 A * 10/1991 Albrecht ..... E04C 2/326 72/177

(Continued)

FOREIGN PATENT DOCUMENTS

GB 2 327 098 A 1/1999
WO WO 2005/049943 A1 6/2005

OTHER PUBLICATIONS http://www.gram.com/au/spf-steel-privacy-fencing/steelplinth-retainingwalls/Gramline Steel Plinth retaining walls (published Jan. 25, 2016, as per Wayback Machine: https://web.archive.org/web/20160125020221/http:/www.gram.com.au:80/spf-steel-privacy-fencing/steelplinth-retaining-walls/).

*Primary Examiner* — Jonathan P Masinick
(74) *Attorney, Agent, or Firm* — Lewis Roca Rothgerber Christie LLP

(57) ABSTRACT

Disclosed is a substantially rectangular plinth member for installation at the base of a fence to at least partially close a space between the fence and a ground surface underneath the fence. The plinth member is elongate and comprises a first major surface and an opposite second major surface. The plinth member has a major axis and a minor axis extending perpendicular thereto, the major and minor axes defining a notional centre plane of the plinth member. The plinth member has first and second end margins at its respective opposite ends along the major axis and third and fourth end margins at its respective opposite ends along the minor axis. A plurality of substantially parallel stiffening formations are defined by portions of the plinth member that are displaced from the notional centre plane, extend between the first and second end margins, and are spaced apart between the third and fourth end margins. The stiffening formations are configured such that the plinth member has a greater pressure load bearing capacity when loaded on the first major surface than it has when loaded on the second major surface.

16 Claims, 4 Drawing Sheets

(58) Field of Classification Search
CPC ..... E04H 17/22; E04H 17/06; E04H 17/063; E04C 2/32; E04C 2/322
See application file for complete search history.

(56) References Cited

U.S. PATENT DOCUMENTS

| | | | | |
|---|---|---|---|---|
| 6,415,581 | B1 * | 7/2002 | Shipman | E04B 5/40 428/593 |
| 7,775,001 | B2 * | 8/2010 | Milliken | E04C 2/322 52/202 |
| 9,506,210 | B2 * | 11/2016 | Southworth | E04H 17/168 |
| 9,506,270 | B2 * | 11/2016 | Knudsen | E04H 17/166 |
| 9,631,331 | B2 * | 4/2017 | Colquhoun | E01F 9/61 |
| 10,335,707 | B2 * | 7/2019 | Nunes | E01F 15/0407 |
| 10,518,499 | B2 * | 12/2019 | Belanger | B32B 21/06 |
| 2002/0139967 | A1 | 10/2002 | Calverley | |
| 2009/0152523 | A1 * | 6/2009 | Erwin | E04H 17/16 256/24 |
| 2010/0295007 | A1 * | 11/2010 | Preston | E04G 21/3233 256/31 |
| 2012/0066997 | A1 * | 3/2012 | Hodgson | E04H 17/16 52/588.1 |
| 2014/0124722 | A1 * | 5/2014 | Mann | E04H 17/165 256/21 |
| 2018/0295790 | A1 * | 10/2018 | Bernardes | A01G 9/025 |

* cited by examiner

FENCE PLINTH MEMBER

CROSS-REFERENCE

This application claims priority to Australian Provisional Patent Application Number 2017902312, filed 16 Jun. 2017, the disclosure of which is incorporated herein by reference in its entirety.

TECHNICAL FIELD

The present disclosure relates to fencing and more specifically to a fence element, referred to herein as a plinth member, for use at the base of a fence. The plinth member has been developed especially, but not exclusively, for metal fencing systems and is herein described in that context. It is to be appreciated, however, that the plinth member may also be used in applications other than metal fencing.

BACKGROUND

It is often desirable to construct a fence so that it closely follows the contour of the underlying ground. Such an arrangement reduces gaps between the fence and the ground and inhibits noise, vermin, weeds, plants, wind, and the like from passing under the fence.

To close gaps under a fence, it is known to install a plinth at the base of the fence, between the fence posts. Conventionally, plinths are either independently supported in the ground, for example using stakes, or secured to the fence posts. It is also known to partially embed a plinth in the ground. In cases where the ground level on either side of the fence differs, a plinth is sometimes used to retain the soil on the higher side.

Plinths are typically constructed from concrete, stone, or timber. Timber planks have been used extensively to construct plinths as they have sufficient strength to retain soil for small differences in soil height, and they can be relatively easily cut to size on site. However, for longevity, the timber is usually treated with chemicals to make it resistant to decay and damage from termites or other pests, and there is a tendency for these chemicals to leach into the soil. As these chemicals can be highly toxic, the use of timber plinths can lead to unacceptable contamination of the surrounding environment. Also, timber plinths are relatively bulky and heavy, which gives rise to handling and installation difficulties.

A disadvantage of concrete plinths is that they are generally formed from precast concrete elements of a standard size and the process of cutting them to size to meet site requirements is very labour and time intensive. They are also very bulky an heavy, which gives rise to handling and installation difficulties. On the other hand, the process of casting concrete plinths on-site is very labour and time intensive.

A stone plinth can be formed from natural stones or from stone blocks. In either case, handling and installation difficulties arise due to stone being a heavy material. The process of creating a plinth from natural stones is also very laborious and time consuming and, unless the stones are bound together using mortar or the like, there will be gaps in the completed plinth. Creating a plinth from stone blocks is also very labour and time intensive, both in terms of the process of laying the stone and in terms of the inevitable need to cut at least some of the stone blocks to size to meet site requirements.

In addition, some conventional plinths suffer from insufficient strength to resist bowing when there is significant soil height differences on one side of the plinth (as often happens on sloping ground).

In the past, plinths have not been available in a paint finish that is the same as the one used for a pre-coated metal fence itself, thus suffering from poor aesthetics and differential fading over a long period of time. Paint applied to such plinths is typically post applied by brush or spray or powder-coating and is applied to each plinth section in a batch or non-continuing process. Where paint is applied to a plinth it needs to have sufficient thickness to ensure it resists the degradation through moisture penetration and may occur in applications involving contact with the soil.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

SUMMARY

Throughout this specification:

the words "comprise" and "include", and variations such as "comprises", "comprising", "includes" and "including", will be understood to imply the inclusion of a stated element, integer or step, or group of elements, integers or steps, but not the exclusion of any other element, integer or step, or group of elements, integers or steps;

the term "metal sheet" will be understood to mean a sheet substantially of metal, but which may also comprise other materials, such as paint and/or galvanic coatings; and the term "base thickness" will be understood to mean the thickness of the material excluding any coatings, such as galvanic or paint coatings.

Disclosed herein is a plinth member for installation at the base of a fence to at least partially close a space between the fence and a ground surface underneath the fence, the plinth member being elongate and comprising:

a first major surface and an opposite second major surface;

a major axis and a minor axis extending perpendicular thereto, the major and minor axes defining a notional centre plane of the plinth member;

first and second end margins at respective opposite ends along the major axis;

third and fourth end margins at respective opposite ends along the minor axis, the third and fourth end margins extending between the first and second end margins, and, together with the first and second end margins, defining a substantially rectangular perimeter margin of the plinth member; and a plurality of substantially parallel stiffening formations that are defined by portions of the plinth member displaced from the notional centre plane, that extend between the first and second end margins, and that are spaced apart between the third and fourth end margins, the stiffening formations being configured such that the plinth member has a greater pressure load bearing capacity when loaded on the first major surface than it has when loaded on the second major surface.

The pressure load bearing capacity of the plinth member when loaded on the first major surface may be at least 1.1 or 1.2 or 1.3 or 1.4 or 1.5 times the pressure load bearing capacity of the plinth member when loaded on the second major surface.

At least some, and in some embodiments all, of the stiffening formations may comprise portions of the plinth member that are displaced by greater than 15 mm or by greater than 20 mm or by about 15 mm to 40 mm or by about 20 mm to 25 mm from the notional centre plane. At least some of these displaced portions may be on a first side of the notional centre plane and at least some of these displaced portions may be on an opposite second side of the notional centre plane. The stiffening formations may comprise corrugations or ribs, which may be formed from smoothly curved portions or planar portions, or a combination of both. The corrugations or ribs on the first side of the notional centre plane may have wider peaks or peaks of greater radius than the peaks of the corrugations or ribs on the second side of the notional centre plane. The stiffening formations may comprise alternating ribs and pans. The mass of the portion of the plinth member on the side of the notional centre plane associated with the first major surface may be greater than the mass of the portion of the plinth member on the other side of the notional centre plane. The mass of the portion of the plinth member on the side of the notional centre plane associated with the first major surface multiplied by the distance of the centre of mass of that portion from the notional centre plane may be greater than the mass of the portion of the plinth member on the other side of the notional centre plane multiplied by the distance of the centre of mass of that portion from the notional centre plane.

The ratio of the length of the plinth member between the first and second end margins to the length of the plinth member between the third and fourth margins, following the contour of the first major surface, may be less than 0.8 or less than 0.7 or between 0.5 and 0.8 or approximately 0.65.

The stiffening formations may extend to either, or both, of the first and second end margins or may terminate inboard of the first and second end margins. The stiffening formations may extend substantially parallel to the third and fourth end margins or at an angle to the third and fourth end margins.

The length of the plinth member measured along the major axis may be between 2 m and 3 m, such as approximately 2.7 m. The height of the plinth member measured along the minor axis may be at least 150 mm, such as at least 200 mm, at least 250 mm or at least 300 mm, and may, for example, be less than about 1 m, such as less than 800 mm, less than 700 mm, less than 600 mm, less than 500 mm or less than 400 mm.

The stiffening formations may be formed by deforming material from which the plinth member is made, for example by roll-forming a sheet of the material or by extruding a billet of the material through a die.

The third and fourth end margins may be configured to allow lapping of the third end margin of one plinth member with the fourth end margin of another plinth member to form a plinth assembly. In at least one embodiment, a stiffening formation on the first side of the notional centre plane may be provided in both the third and fourth end margins. In such an embodiment, when two plinth members are lapped, the stiffening formation in the third end margin of one plinth member is lapped over the stiffening formation in the fourth end margin of the other plinth member. In at least another embodiment, a stiffening formation on the second side of the notional centre plane may be provided in both the third and fourth end margins. In such an embodiment, when two plinth members are lapped, the stiffening formation in the third end margin of one plinth member is lapped over the stiffening formation in the fourth end margin of the other plinth member.

The plinth member may be configured to be stackable with the first major surface of one plinth member facing the second major surface of a like plinth member. When stacked, the plinth members are substantially coterminous, at least along their third and fourth end margins.

The first and second major surfaces, including the stiffening formations, may be configured to allow free drainage of water across those surfaces when the plinth member is oriented with the first and second edge margins substantially vertical.

The plinth member may comprise sheet material, such as metal sheet. The sheet material may be pre-coated steel, such as galvanised steel with or without an outer paint layer. The sheet material may have a base thickness of between approximately 0.5 mm and approximately 1 mm. For example, the sheet material may have a base thickness of approximately 0.8 mm.

Also disclosed herein is a kit for constructing a fence panel, the kit comprising:

a pair of posts, each of the posts defining a longitudinal axis and comprising a first portion for embedment in ground on which the fence panel is to be constructed and a second portion that is to extend from the ground, the second portion having an upper end distal from the first portion and a lower end proximal to the first portion;

an upper rail for interconnecting the pair of posts at or adjacent the upper ends of their second portions;

a lower rail for interconnecting the pair of posts adjacent the lower ends of their second portions at a location spaced from their first portions;

one or more infill member for installation in a first space bounded by the upper and lower rails and the portion of the posts between the upper and lower rails, wherein the one or more infill member at least partially infills the first space;

one or more plinth member as defined in any one of paragraphs [0011] to [0021] above for installation in a second space defined between the lower rail and a portion of the posts below the lower rail, wherein, with the one or more plinth member installed in the second space:

the one or more plinth member extends between the posts, and the stiffening formations of the one or more plinth member extend substantially transversely with respect to the longitudinal axis of each post.

Also disclosed herein is a fence panel comprising:

a pair of posts comprising a first post and a second post, each of the posts defining a longitudinal axis and comprising a first portion for embedment in ground on which the fence panel is to be constructed and a second portion that is to extend from the ground, the second portion having an upper end distal from the first portion and a lower end proximal to the first portion;

an upper rail interconnecting the pair of posts at or adjacent the upper ends of their second portions;

a lower rail interconnecting the pair of posts adjacent the lower ends of their second portions at a location spaced from their first portions;

one or more infill member installed in a first space bounded by the upper and lower rails and the portion of the posts between the upper and lower rails, wherein the one or more infill member at least partially infills the first space;

one or more plinth member as defined in any one of paragraphs [0011] to [0021] above installed in a second space defined between the lower rail and a portion of the posts below the lower rail, wherein the one or more plinth member extends between the posts, and wherein the stiffening formations of the one or more plinth member extend substantially transversely with respect to the longitudinal axis of each post.

Each of the posts may define a corresponding elongate channel. The channel of the first post may face toward the channel of the second post. The first end margin of the or each one or more plinth member may extend into the channel of the first post and the second end margin of the or each one or more plinth member may extend into the channel of the second post. The first and second end margins of the plinth member(s) and the channels of the posts may have a relative configuration that facilitates snug engagement of the first and second end margins of the plinth member(s) in the channels of the posts. The first and second end margins of the plinth member(s) may each be fixedly connected to the respective post, for example by screws, bolts or other mechanical fasteners.

Each of the rails may define a corresponding elongate channel. The channel of the upper rail may face toward the channel of the lower rail. The or each one or more infill member may have a first end that extends into the channel of the lower rail and an opposite second end that extends into the channel of the upper rail. The first and second ends of the infill member(s) may be fixedly connected to the respective rail, for example by screws, bolts or other mechanical fasteners. A third rail may interconnect the posts, the lower rail being located between the upper rail and the third rail. The third rail may define a corresponding elongate channel. The channel of the third rail and the channel of the lower rail may face away from one another and in opposite directions to one another. The third and/or fourth end margins of the plinth member(s) and the channel of the third rail may have a relative configuration that facilitates engagement of the third and/or fourth end margins of the plinth member(s) in the channel of the third rail. Each of the rails may be generally U-shaped in transverse cross section, comprising a web with flanges extending from opposite ends thereof.

The fence panel may comprise a plurality of the plinth members located one above the other. Adjoining plinth members of the plurality of plinth members may be partially overlapped, with the third end margin of one of the adjoining plinth members being lapped over the fourth end margin of the other the other to define a plinth assembly.

In embodiments comprising a single plinth member, the portion of the posts below the lower rail may have a length that is greater than a height of the plinth member measured along the minor axis of the plinth member. In embodiments comprising an assembly of lapped plinth members, the portion of the posts below the rail may have a length that is greater than a height of the plinth assembly measured along the minor axis of the plinth members. As such, in either case, when the plinth member or plinth assembly is installed with its upper end adjacent the lower rail, the first portion of the posts extends beyond the lower end of the plinth member or plinth assembly.

The infill member(s) may, for example, comprise: a planar, rigid sheet; a profiled, rigid sheet, such as may be formed by roll-forming or extrusion; a rigid mesh, such as a mesh of expanded metal or a woven or welded wire mesh; a plurality of spaced apart pickets; or any other barrier for inhibiting the passage of people or animals between the posts.

Also disclosed herein is a method of using a fence panel as defined in any one of paragraphs [0023] to [0028] above to retain ground on one side of the fence panel that is higher than ground on the other side of the fence panel, the method comprising:

embedding the first portion of each of the posts in the ground;

installing the or each one or more plinth members in the second space such that the first major surface of the or each plinth member faces toward the ground to be retained.

BRIEF DESCRIPTION OF DRAWINGS

Embodiments of the principles disclosed herein will now be described, by way of example only, with reference to the accompanying drawings, in which.

DESCRIPTION OF EMBODIMENTS

Figure 1:
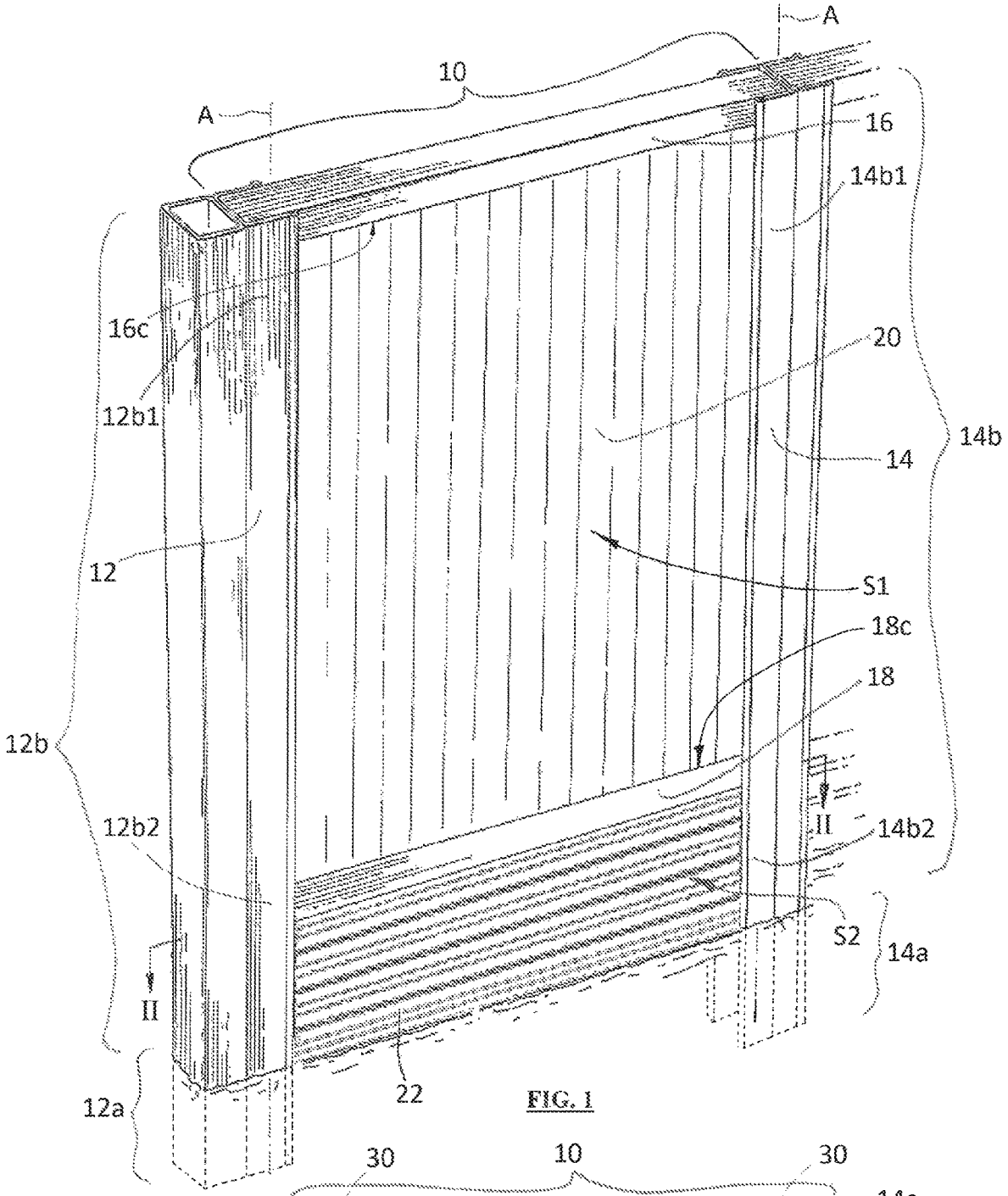
FIG. 1 is a perspective view of a fence panel comprising a plinth member embodying the presently disclosed principles.
Figure 2:
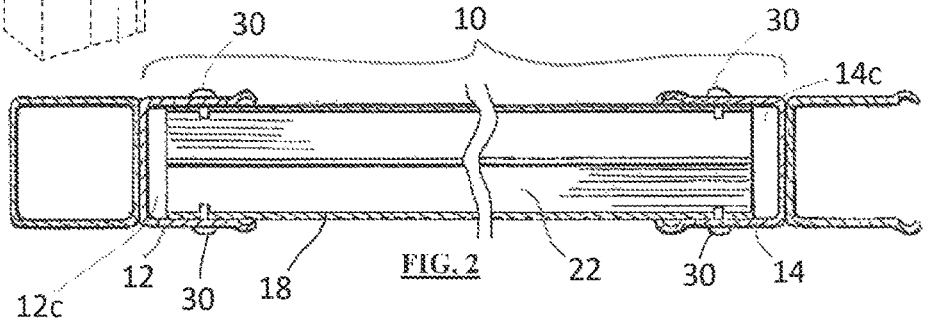
FIG. 2 is a cross sectional view taken horizontally through the fence panel of FIG. 1 along line II-II.

Referring to the drawings, and initially to FIGS. 1 and 2, there is shown a fence panel 10 comprising a pair of posts, including a first post 12 and a second post 14. Each of the posts defines a longitudinal axis A and comprises a first portion 12*a*, 14*a* for embedment in ground on which the fence panel is to be constructed and a second portion 12*b*, 14*b* that is to extend from the ground. The second portion 12*b*, 14*b* has an upper end 12*b*1, 14*b*1 distal from the first portion 12*a*, 14*a* and a lower end 12*b*2, 14*b*2 proximal to the first portion. An upper rail 16 interconnects the posts 12, 14 at or adjacent the upper ends of their second portions 12*b*, 14*b*. A lower rail 18 interconnects the posts 12, 14 adjacent the lower ends of their second portions 12*b*, 14*b* at a location spaced from their first portions 12*a*, 14*a*. One or more infill member, such as roll formed, profiled sheets 20, is installed in a first space S1 bounded by the upper and lower rails 16, 18 and the portion of the posts 12, 14 between the upper and lower rails. In the illustrated embodiment, the infill members 20 substantially completely infill space S1. One or more plinth member 22 is installed in a second space S2 defined between the lower rail 18 and a portion of the posts 12, 14 below the lower rail. The plinth member 22 extends between the posts 12, 14. In the embodiment shown in FIG. 1, the ground surface at the front of the fence panel 10 is at the same level as the ground surface at the rear of the fence panel, the space S2 extends from the lower rail 18 to the ground surface under the fence panel, and plinth member 22 substantially completely closes space S2. In other embodiments, the ground surface at the front of the fence panel 10 may be at a different level to the ground surface at the rear of the fence panel, the space S2 may extend from the lower rail 18 to the lowermost of the front and rear ground surface, and plinth member 22 may substantially completely close space S2 to retain the ground under the fence panel 10. In yet further embodiments, irrespective of whether the front and rear ground surfaces are at the same or a different level, the space S2 may extend from the lower rail 18 to the lowermost of the ground surfaces, and plinth member 22 may partially close space S2.

Plinth member 22 will now be described in more detail with reference to FIGS. 3 and 4. Plinth member 22 is elongate and comprises a first major surface 22*a* and an opposite second major surface 22*b*, and a major axis X and a minor axis Y extending perpendicular thereto. The major and minor axes X, Y define a notional centre plane of the plinth member 22. The plinth member 22 has first and second end margins 22*c*, 22*d* at respective opposite ends along the major axis X, and third and fourth end margins 22*e*, 22*f* at respective opposite ends along the minor axis Y. The third and fourth end margins 22*e*, 22*f* extend between the first and second end margins 22*c*, 22*d*, and, together with the first and second end margins, define a substantially rectangular perimeter margin of the plinth member 22. A plurality of substantially parallel stiffening formations 24 extend between the first and second end margins 22*c*, 22*d*. The stiffening formations 24 are spaced between the third and fourth end margins 22*e*, 22*f* and are configured such that the plinth member 22 has a greater pressure load bearing capacity when loaded on the first major surface 22*a* than it has when loaded on the second major surface 22*b*. In use, the stiffening formations 24 extend substantially transversely with respect to the longitudinal axes A of the posts 12, 14.

The configuration of the plinth member 22, and especially of the stiffening formations 24, is such that the pressure load bearing capacity P1 of the plinth member 22 when loaded on the first major surface 22*a* is at least 1.1 times the pressure load bearing capacity P2 of the plinth member when loaded on the second major surface 22*b*. In other embodiments, P1 is up to around 1.5 times P2.

Figure 4:
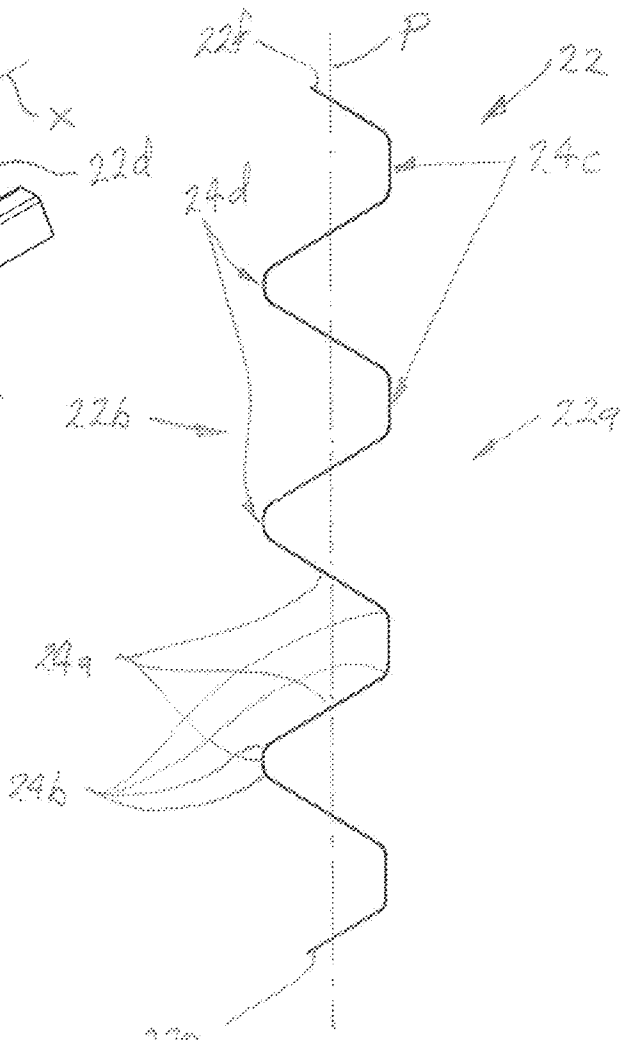
FIG. 4 is a cross sectional view taken along line IV-IV of FIG. 3.
Figure 3:
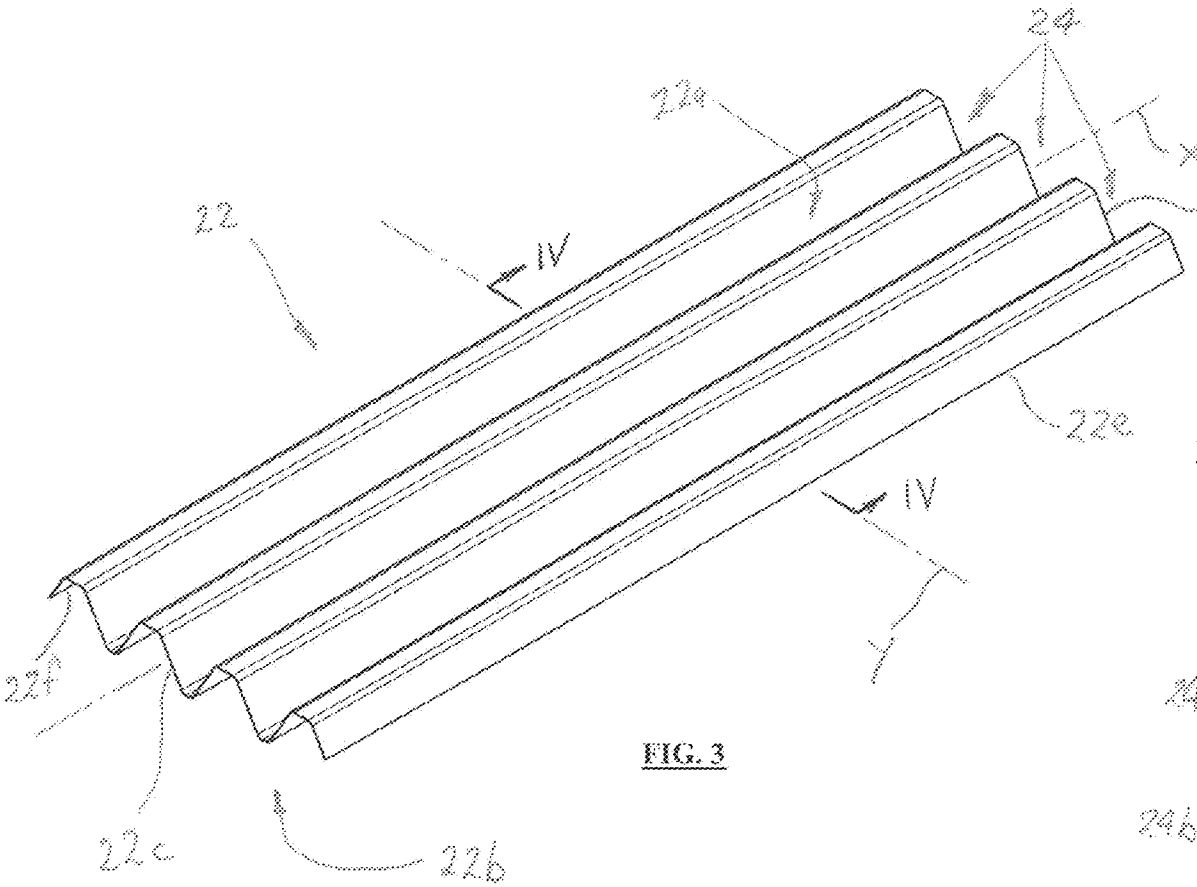
FIG. 3 is a perspective view of a partial length of the plinth member used in the fence panel of FIG. 1.

As best seen in FIGS. 3 and 4, the stiffening formations 24 are defined by portions of the plinth member 22 that are displaced from its notional centre plane P. In the illustrated embodiment, the stiffening formations 24 comprise corrugations or ribs, which are formed from planar portions 24*a* with smoothly curved transition portions 24*b* therebetween. The stiffening formations 24 on a first side of the notional centre P plane of the plinth member 22 have wider peaks 24*c* than the peaks 24*d* of the stiffening formations 24 on the second side of the notional centre plane P. In the illustrated embodiment, the peaks 24*c*, 24*d* of the stiffening formations 24 are displaced by about 25 mm from plane P. In other embodiments, the stiffening formations 24 may be displaced from plane P by a greater or lesser extent.

It will be appreciated that in plinth member 22, the mass M1 of the portion of the plinth member on the first side of plane P is greater than the mass M2 of the portion of the plinth member on the second side of plane P. Moreover, M1 multiplied by the distance of the centre of mass of M1 from plane P is greater than M2 multiplied by the distance of the centre of mass of M2 from plane P. As such, capacity of the plinth member 22 to bear load on the first side of plane P (i.e., on the first major surface 22*a*) is greater than its capacity to bear load on the second side of plane P (i.e., on the first major surface 22*b*).

In the illustrated embodiment, stiffening formations 24 extend from both sides of plane P. In other embodiments, stiffening formations 24 (and the displaced portions of the plinth member 22 that define them) may extend from only one side of plane P and may, for example, comprise alternating ribs and pans.

In the illustrated embodiment, the stiffening formations 24 extend between the first and second end margins 22*c*, 22*d* along the full length of the plinth member 22. In other embodiments, the only part way along the plinth member 22 and may, for example, terminate inboard of the first and second end margins 22*c*, 22*d*. In the illustrated embodiment, the stiffening formations 24 extend substantially parallel to the third and fourth end margins 22*e*, 22*f*, but, in other embodiments, may extend at an angle to the third and fourth end margins.

In the illustrated embodiment, the length of the plinth member 22 measured between the first end margin 22*c* and the second end margin 22*d* is approximately 2.7 m, which is a common fence panel width. However, the plinth member 22 may be longer or shorter, as required, for fence panels of longer or shorter width. In the illustrated embodiment, the height of the plinth member 22 measured between the third end margin 22*e* and the fourth end margin 22*f* is approximately 325 mm. However, in other embodiments, the plinth member 22 may be of greater or lesser height.

Figure 5:
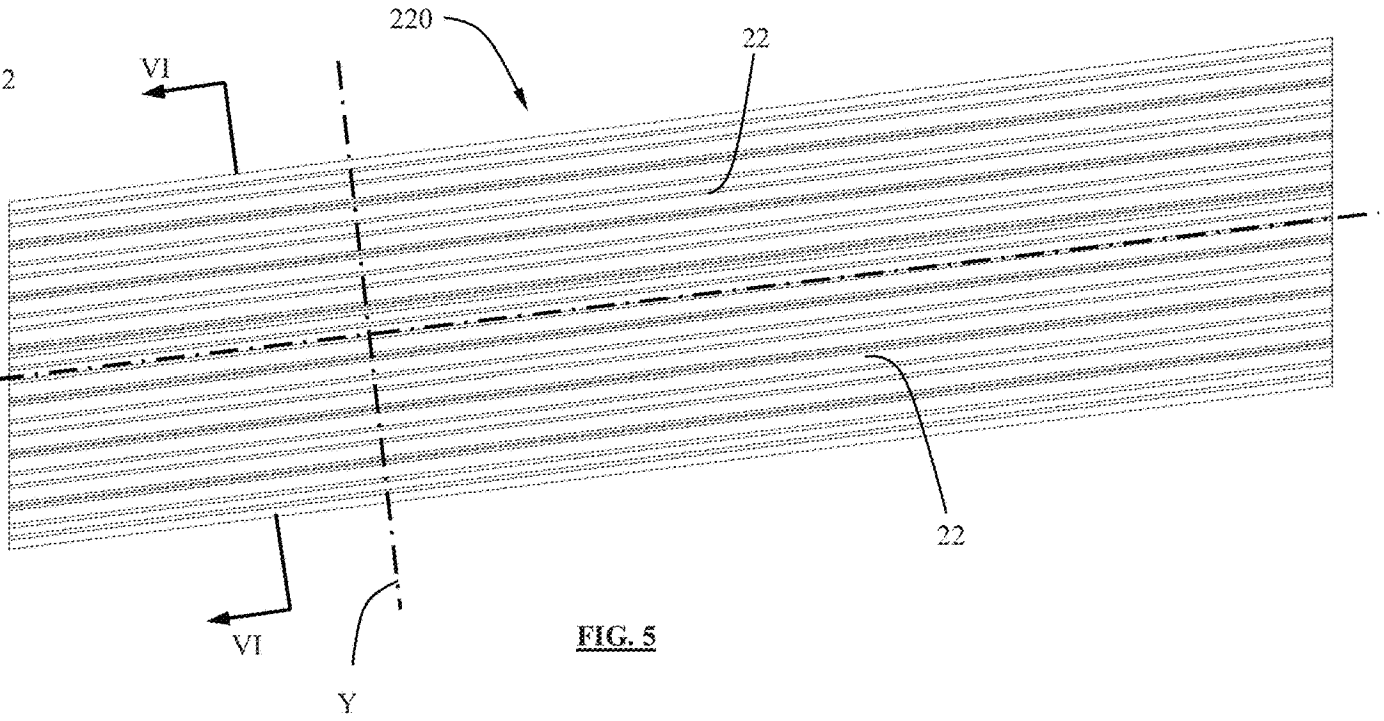
FIG. 5 is a front elevational view of a plinth assembly comprising two lapped plinth members embodying the presently disclosed principles.
Figure 6:
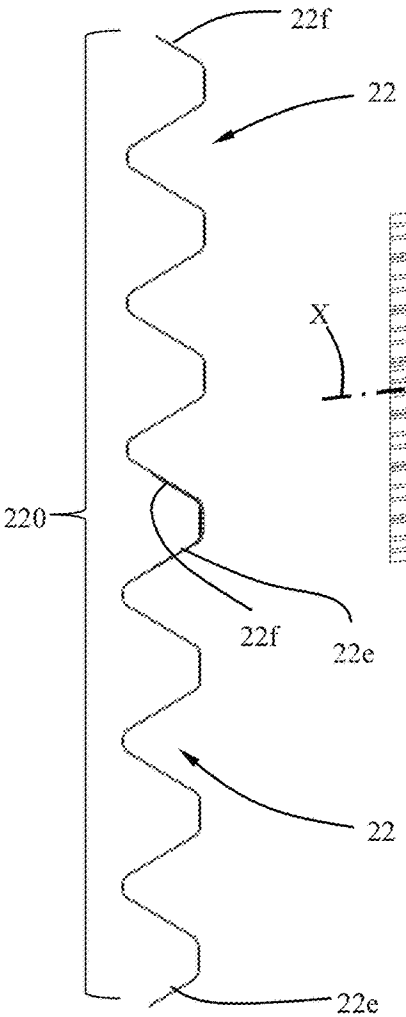
FIG. 6 is a cross sectional view taken along line VI-VI of FIG. 5.

As best seen in FIGS. 5 and 6, the third and fourth end margins 22*e*, 22*f* are configured to allow lapping of the third end margin 22*e* of one plinth member 22 with the fourth end margin 22*f* of another plinth member 22 to form a plinth assembly 220. A stiffening formation 24 on the first (higher pressure load capacity) side of the notional centre plane P of the plinth member 22 is provided in both the third and fourth end margins 22*e*, 22*f* When the two plinth members 22 are lapped as shown in FIGS. 5 and 6, a stiffening formation 24 in the third end margin 22*e* of the upper plinth member 22 is lapped over a stiffening formation 24 in the fourth end margin 22*f* of the lower plinth member 22. In another embodiment, a stiffening formation 24 on the second (lower pressure load capacity) side of plane P of the plinth member 22 may be provided in both the third and fourth end margins 22*e*, 22*f*, with the stiffening formation 24 in the third end margin 22*e* of one plinth member 22 being lapped over the stiffening formation 24 in the fourth end margin 22*f* of the other plinth member 22 when two plinth members 22 are lapped. The plinth members 22 in FIGS. 5 and 6 are shown oriented at an angle to horizontal, as would be the case when used in a fence panel 10 that is sloped to more closely follow a sloping ground surface. To facilitate good fit with posts 12, 14, which even in a sloped fence panel 10 are vertical, the longitudinal ends of the angled plinth members 22 shown in FIGS. 5 and 6 are trimmed at an angle such that they will be substantially vertical when connected to the posts 12, 14.

The plinth member 22 is configured to be stackable with the first major surface 22*a* of one plinth member 22 facing the second major surface 22*b* of a like plinth member 22. When stacked, the plinth members 22 are substantially coterminous, along their third and fourth end margins 22*e*, 22*f*, and, if they are of the same length, also along their first and second end margins 22*c*, 22*d*.

The stiffening formations 24 are configured to allow free drainage of water across the first and second major surfaces 22*a*, 22*b* when the plinth member 22 is oriented with the first and second edge margins 22*c*, 22*d* oriented substantially vertically.

In the illustrated embodiments, plinth member 22 is roll formed from pre-coated steel, such as galvanised steel with or without an outer paint layer(s). The galvanised steel sheet from which the plinth member 22 is roll formed has a base metal thickness of 0.8 mm. In other embodiments, the plinth member 22 may be formed from a material having a different base thickness and/or from another material, such as a different metal and/or may have its profile imparted using a method other than roll forming, such as by extrusion of a billet of material through a die.

Having described the plinth member 22 in some detail, other particulars of the fence panel 10 will now be more fully described.

As best seen in FIG. 2, each of the posts 12, 14 defines a corresponding elongate channel 12*c*, 14*c*. The channel 12*c* of post 12 faces toward the channel 14*c* of post 14. The first end margin 22*c* of the plinth member(s) extends into channel 12*c* and the second end margin 22*d* of the plinth member(s) extends into channel 14*c*. In the illustrated embodiment, the first and second end margins 22*c*, 22*d* of the plinth member (s) 22 and channels 12*c*, 14*c* have a relative configuration that facilitates snug engagement of the first and second end margins in the channels. However, the first and second end margins 22*c*, 22*d* of the plinth member(s) 22 may alternatively or additionally be fixedly connected to the respective post 12, 14, such as by screws 30, bolts or other mechanical fasteners, which may, for example, extend through the sidewalls of channels 12*c*, 14*c* and into the first and second end margins 22*c*, 22*d* of the plinth member(s) 22.

In fence panel 10 of FIGS. 1 and 2, each of the rails 16, 18 is generally U-shaped in transverse cross section, comprising a web with flanges extending from opposite ends thereof to define an elongate channel 16*c*, 18*c*. The channel 16*c* of the upper rail 16 faces toward the channel 18*c* of the lower rail 18. The infill member(s) 20 have a first (lower) end that extends into channel 18*c* and an opposite second (upper) end that extends into channel 16*c*. The first and second ends of the infill member(s) 20 may be fixedly connected to the respective rail 18, 16, for example by screws, bolts or other mechanical fasteners, or by mechanical or frictional interlock. In other embodiments, a third rail of similar configuration to rails 16, 18 may interconnect the posts 12, 14 and may be located below rail 18. In such embodiments, the channel of the third rail faces downwardly away from channel 18*c*, and the third end margins 22*f* of the plinth member(s) 22 and the channel of the third rail have a relative configuration that facilitates engagement of the third end margins of the plinth member(s) in the channel of the third rail.

In embodiments where the fence panel 10 comprises a single plinth member 22 in space S2, the portion of the posts 12, 14 below the lower rail 18 has a length that is greater than a height of the plinth member 22 measured along the minor axis Y of the plinth member. In embodiments where the fence panel 10 comprises an assembly 220 of lapped plinth members 22 in space S2, the portion of the posts 12, 14 below rail 18 has a length that is greater than a height of the plinth assembly 220 measured along the minor axis Y of the plinth members 22. As such, in either case, when the plinth member 22 or plinth assembly 220 is installed with its upper end adjacent the lower rail 18, the first portion 12*a*, 14*a* of the posts extends beyond the lower end of the plinth member or plinth assembly.

In the fence panel 10 shown in FIGS. 1 and 2, the infill member(s) 20 is a roll formed, profiled sheet. In other embodiments, however, the infill member 20 may be: a planar, rigid sheet; a mesh, such as a mesh of expanded metal or a woven or welded wire mesh; a plurality of spaced apart pickets or palings; any other barrier for inhibiting the passage of people or animals between the posts 12, 14; and/or may be profiled using a method other than roll forming, such as extrusion.

As discussed above, a fence panel 10 comprising plinth member(s) 22 can be used to retain ground in circumstances where the ground on one side of the fence panel 10 is higher than the ground on the other side. When used for this purpose, the first portion 14*a* of each of the posts 14 is embedded in the ground to a sufficient depth below the ground level on the lower side of the fence panel 10, and a plinth member 22 or plinth assembly 220 is installed in the second space S2 such that the first major surface 22*a* of the plinth member(s) 22 faces toward the ground to be retained.

Figure 7:
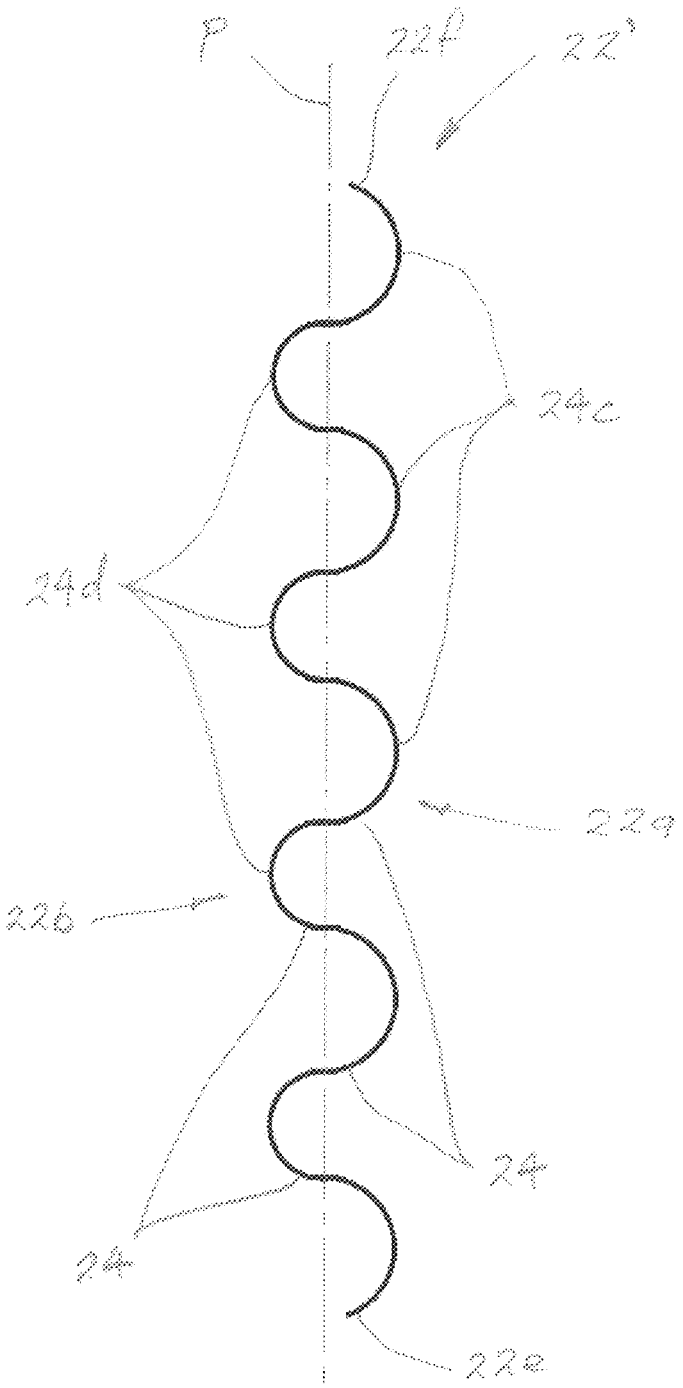
FIG. 7 is a view corresponding to that of FIG. 4, but showing an alternative plinth member embodiment.

An alternative embodiment of a plinth member 22' is shown in FIG. 7. This embodiment has many features in common with the embodiment described above with reference to FIGS. 1 to 4, where corresponding reference numerals indicate corresponding features with corresponding functionality. In the FIG. 7 embodiment, however, the plinth member 22' has smoothly curved stiffening formations 24, with the stiffening formations 24 on the first side of its notional centre plane P having peaks 24*c* of greater radius than the peaks 24*d* of the stiffening formations 24 on the second side of the notional centre plane.

It will be appreciated that configuring the plinth member 22, 22' to have a higher pressure load capacity on one side of its nominal centre plane P than on the other side facilitates the plinth member 22, 22' being suitable for retaining ground by orienting the higher pressure load capacity side toward the retained ground without overdesigning the side of the plinth member that is not required to retain ground. As such, the plinth member requires less sheet steel for its manufacture than would be the case if the plinth member 22, 22' was designed to be strong enough to retain ground but had an equal load bearing capacity on both sides (as the non-ground retaining side of the plinth member 22, 22' would be overdesigned in terms of its pressure load bearing capacity). For example, in the embodiment shown in FIGS. 3 and 4, plinth member 22 uses sheet steel that is 510 mm wide prior to roll forming, with that dimension being reduced to the approximately 325 mm height of plinth member 22 after roll forming. However, if the plinth member 22 were formed with wide peaked stiffening formations on both sides of its nominal centre plane P (such that both sides have a pressure load capacity sufficient to retain ground), substantially wider sheet steel would need to be used to form the plinth member due to the wider peaked stiffening formations on the second side increasing the path length between the third and fourth edge margins of the plinth member. Similarly, if the plinth member 22 is extruded from a billet of material, it requires less material from the billet than would be required for a plinth member that had wide peaked stiffening formations on both sides of its nominal centre plane P.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A plinth member for installation at the base of a fence to at least partially close a space between the fence and a ground surface underneath the fence, the plinth member being elongate and comprising:

a first major surface and an opposite second major surface;

a major axis and a minor axis extending perpendicular thereto, the major and minor axes defining a notional centre plane of the plinth member;

first and second end margins at its respective opposite ends along the major axis;

third and fourth end margins at its respective opposite ends along the minor axis, the third and fourth end margins extending between the first and second end margins, and, together with the first and second end margins, defining a substantially rectangular perimeter margin of the plinth member; and a plurality of substantially parallel stiffening formations that are defined by portions of the plinth member that are displaced from the notional centre plane, that extend between the first and second end margins, and that are spaced apart between the third and fourth end margins, the stiffening formations being configured such that the plinth member has a greater pressure load bearing capacity when loaded on the first major surface than it has when loaded on the second major surface.

2. The plinth member as claimed in claim 1, wherein the pressure load bearing capacity of the plinth member when loaded on the first major surface is at least 1.1 times its pressure load bearing capacity when loaded on the second major surface.

3. The plinth member as claimed in claim 2, wherein the pressure load bearing capacity of the plinth member when loaded on the first major surface is at least 1.3 times its pressure load bearing capacity when loaded on the second major surface.

4. The plinth member as claimed in claim 1, wherein at least some of the stiffening formations comprise a portion that is displaced by between 15 mm and 40 mm from the notional centre plane.

5. The plinth member as claimed in claim 4, wherein at least some of the stiffening formations comprise a portion that is displaced by between 15 mm and 25 mm from the notional centre plane.

6. The plinth member as claimed in claim 1, wherein at least some of the stiffening formations extend on a first side of the notional centre plane and at least some of the stiffening formations extend on an opposite second side of the notional centre plane.

7. The plinth member as claimed in claim 6, wherein the stiffening formations comprise corrugations or ribs, and wherein the corrugations or ribs on the side of the notional centre plane associated with the first major surface have wider peaks or peaks of greater radius than the peaks of the corrugations or ribs on the other side of the notional centre plane.

8. The plinth member as claimed in claim 1, wherein the mass of the portion of the plinth member on the side of the notional centre plane associated with the first major surface is greater than the mass of the portion of the plinth member on the other side of the notional centre plane.

9. The plinth member as claimed in claim 1, wherein the mass of the portion of the plinth member on the side of the notional centre plane associated with the first major surface multiplied by the distance of the centre of mass of that portion from the notional centre plane is greater than the mass of the portion of the plinth member on the other side of the notional centre plane multiplied by the distance of the centre of mass of that portion from the notional centre plane.

10. The plinth member as claimed in claim 1, wherein the ratio of the length of the plinth member between the first and second end margins to the length of the plinth member between the third and fourth margins, following the contour of the first major surface, is between 0.5 and 0.8.

11. The plinth member as claimed in claim 1, having: a length, measured along the major axis, of between 2 m and 3 m; and a height, measured along the minor axis, of at least 150 mm.

12. The plinth member as claimed in claim 11, wherein the height of the plinth member, measured along the minor axis, is less than 500 mm.

13. The plinth member as claimed in claim 1, wherein the first and second major surfaces, inclusive of the stiffening formations, are configured to allow free drainage of water across those surfaces when the plinth member is oriented with the first and second edge margins substantially vertical.

14. A kit for constructing a fence panel, the kit comprising:

a pair of posts, each of the posts defining a longitudinal axis and comprising a first portion for embedment in ground on which the fence panel is to be constructed and a second portion that is to extend from the ground, the second portion having an upper end distal from the first portion and a lower end proximal to the first portion;

an upper rail for interconnecting the pair of posts at or adjacent the upper ends of their second portions;

a lower rail for interconnecting the pair of posts adjacent the lower ends of their second portions at a location spaced from their first portions;

one or more infill member for installation in a first space bounded by the upper and lower rails and the portion of the posts between the upper and lower rails, wherein the one or more infill member at least partially infills the first space;

one or more elongate plinth member for installation in a second space defined between the lower rail and a portion of the posts below the lower rail, each said one or more plinth member comprising:

a first major surface and an opposite second major surface;

a major axis and a minor axis extending perpendicular thereto, the major and minor axes defining a notional centre plane of the plinth member;

first and second end margins at its respective opposite ends along the major axis;

third and fourth end margins at its respective opposite ends along the minor axis, the third and fourth end margins extending between the first and second end margins, and, together with the first and second end margins, defining a substantially rectangular perimeter margin of the plinth member; and a plurality of substantially parallel stiffening formations that are defined by portions of the plinth member that are displaced from the notional centre plane, that extend between the first and second end margins, and that are spaced apart between the third and fourth end margins, the stiffening formations being configured such that the plinth member has a greater pressure load bearing capacity when loaded on the first major surface than it has when loaded on the second major surface, wherein, with the one or more plinth member installed in the second space:

the one or more plinth member extends between the posts, and the stiffening formations of the one or more plinth member extend substantially transversely with respect to the longitudinal axis of each post.

15. A fence panel comprising:

a pair of posts comprising a first post and a second post, each of the posts defining a longitudinal axis and comprising a first portion for embedment in ground on which the fence panel is to be constructed and a second portion that is to extend from the ground, the second portion having an upper end distal from the first portion and a lower end proximal to the first portion;

an upper rail interconnecting the pair of posts at or adjacent the upper ends of their second portions;

a lower rail interconnecting the pair of posts adjacent the lower ends of their second portions at a location spaced from their first portions;

one or more infill member installed in a first space bounded by the upper and lower rails and the portion of the posts between the upper and lower rails, wherein the one or more infill member at least partially infills the first space;

one or more elongate plinth member for installation in a second space defined between the lower rail and a portion of the posts below the lower rail, each said one or more plinth member comprising:

a first major surface and an opposite second major surface;

a major axis and a minor axis extending perpendicular thereto, the major and minor axes defining a notional centre plane of the plinth member;

first and second end margins at its respective opposite ends along the major axis;

third and fourth end margins at its respective opposite ends along the minor axis, the third and fourth end margins extending between the first and second end margins, and, together with the first and second end margins, defining a substantially rectangular perimeter margin of the plinth member; and a plurality of substantially parallel stiffening formations that are defined by portions of the plinth member that are displaced from the notional centre plane, that extend between the first and second end margins, and that are spaced apart between the third and fourth end margins, the stiffening formations being configured such that the plinth member has a greater pressure load bearing capacity when loaded on the first major surface than it has when loaded on the second major surface, wherein, with the one or more plinth member installed in the second space:

the one or more plinth member extends between the posts, and the stiffening formations of the one or more plinth member extend substantially transversely with respect to the longitudinal axis of each post.

16. A method of using a fence panel to retain ground on one side of the fence panel that is higher than ground on the other side of the fence panel, the method comprising:

providing a fence panel comprising:

a pair of posts comprising a first post and a second post, each of the posts defining a longitudinal axis and comprising a first portion for embedment in ground on which the fence panel is to be constructed and a second portion that is to extend from the ground, the second portion having an upper end distal from the first portion and a lower end proximal to the first portion, an upper rail interconnecting the pair of posts at or adjacent the upper ends of their second portions, a lower rail interconnecting the pair of posts adjacent the lower ends of their second portions at a location spaced from their first portions, one or more infill member installed in a first space bounded by the upper and lower rails and the portion of the posts between the upper and lower rails, wherein the one or more infill member at least partially infills the first space, one or more elongate plinth member for installation in a second space defined between the lower rail and a portion of the posts below the lower rail, each said one or more plinth member comprising, a first major surface and an opposite second major surface, a major axis and a minor axis extending perpendicular thereto, the major and minor axes defining a notional centre plane of the plinth member, first and second end margins at its respective opposite ends along the major axis, third and fourth end margins at its respective opposite ends along the minor axis, the third and fourth end margins extending between the first and second end margins, and, together with the first and second end margins, defining a substantially rectangular perimeter margin of the plinth member, and a plurality of substantially parallel stiffening formations that are defined by portions of the plinth member that are displaced from the notional centre plane, that extend between the first and second end margins, and that are spaced apart between the third and fourth end margins, the stiffening formations being configured such that the plinth member has a greater pressure load bearing capacity when loaded on the first major surface than it has when loaded on the second major surface;

embedding the first portion of each of the posts in the ground; and installing the one or more plinth member in the second space such that:

the first major surface of the one or more plinth member faces toward the ground to be retained;

the one or more plinth member extends between the posts, and the stiffening formations of the one or more plinth member extend substantially transversely with respect to the longitudinal axis of each post.

* * * * *